United States Patent [19]

Derhaag et al.

[11] Patent Number: 4,815,143

[45] Date of Patent: Mar. 21, 1989

[54] WIRELESS MICROPHONE

[75] Inventors: Robert L. Derhaag, San Marcos; Donald A. Kutz, Del Mar, both of Calif.

[73] Assignee: HM Electronics, Inc., San Diego, Calif.

[21] Appl. No.: 31,401

[22] Filed: Mar. 27, 1987

[51] Int. Cl.[4] ..... H01H 9/20; H04R 7/00

[52] U.S. Cl. ..... 381/168; 381/169; 200/43.17; 200/43.16; 200/332.2

[58] Field of Search ..... 381/168, 169; 379/421, 379/422, 420; 200/43.16, 43.17, 43.18, 157, 327, 328

[56] References Cited

U.S. PATENT DOCUMENTS

| | | | |
|---|---|---|---|
| 3,787,742 | 1/1974 | Murphy | 200/157 |
| 3,922,489 | 11/1975 | Ojima et al. | 381/169 |
| 4,468,544 | 8/1984 | Wainess et al. | 200/43.16 |
| 4,592,144 | 6/1986 | Tolbert et al. | 200/157 |

*Primary Examiner*—John W. Caldwell, Sr.
*Assistant Examiner*—Alvin Oberley
*Attorney, Agent, or Firm*—Bernard L. Kleinke

[57] ABSTRACT

A wireless microphone having an on/off safety switch, and a mute safety switch. The microphone includes a generally elongated handle, having a slit-like elongated slot, disposed on the side of the microphone, for substantially entirely housing an on/off control button and detent, and a mute control button and locking detent, out of contact with the user's fingers, in order to prevent inadvertent manipulation thereof.

15 Claims, 6 Drawing Sheets

WIRELESS MICROPHONE

Technical Field

The present invention relates in general to wireless microphones, and it more particularly relates to a new and improved wireless microphone having specially designed controls to prevent inadvertent deactivation thereof during use.

Background Art

A conventional wireless microphone is generally equipped with an on/off switch, and a mute switch, which are used to deactivate the microphone selectively. It is generally recommended that the microphone be muted or turned off, when a performer desires to leave the stage temporarily, in order to prevent undesired transmissions. A performer deactivates the mute switch by a manually operable control on the microphone. Subsequently, when the performer returns to the stage, he or she reactivates the microphone by actuating the mute control, generally in the opposite direction. However, on several occasions, while the user is performing on the stage, he or she may inadvertently activate either the on/off control, or the mute control, thus deactivating the microphone, and thereby disrupting the continuity of the performance.

Several attempts have been made to overcome this problem. For example, conventional wireless microphones are equipped with an on/off control and a mute control, disposed on the bottom end of the microphone, for placing such controls outside the reach of the performer's fingers. While such disposition of the control buttons reduces the probability of inadvertent deactivation of the microphone, it does not present an aesthetically pleasing appearance. In this regard, when the microphone is in use, its bottom is generally tilted toward the audience or the camera, thus emphasizing the unsightly appearance of the microphone control.

Therefore, it would be highly desirable to have a wireless microphone which addresses the above problems of the prior art, and which provides adequate and relatively inexpensive solutions thereto. Such a wireless microphone should not be able to be inadvertently deactivated during its normal operation. It should also have a very aesthetically pleasing appearance, since it is designed to be held in front of the face of the performer.

Disclosure of Invention

Therefore, it is the principal object of the present invention to provide a new and improved wireless microphone, which can not be inadvertently deactivated during normal use, and which has a very aesthetically pleasing appearance.

Briefly, the above and further objects and features of the present invention are realized by providing a wireless microphone having an on/off safety switch control, and a mute safety switch control. The microphone includes a generally elongated handle, having a slit-like longitudinally-extending elongated slot, disposed on the side of the microphone, for receiving an on/off control button and detent, and a mute control button and locking detent, substantially out of contact with the user's fingers during use, in order to prevent inadvertent manipulation thereof.

Furthermore, the tapered elegant clean appearance of the microphone does not present any unsightly protuberances, since the control buttons, and their respective detent mechanisms, are substantially entirely disposed within the elongated slot, concealed under the finger of the user out of view of the audience.

Brief Description of Drawings

The above mentioned and other objects and features of this invention and the manner of attaining them will become apparent, and the invention itself will be best understood by reference to the following description of the embodiment of the invention in conjunction with the accompanying drawings, wherein.

Best Mode for Carrying Out the Invention

Figure 1:
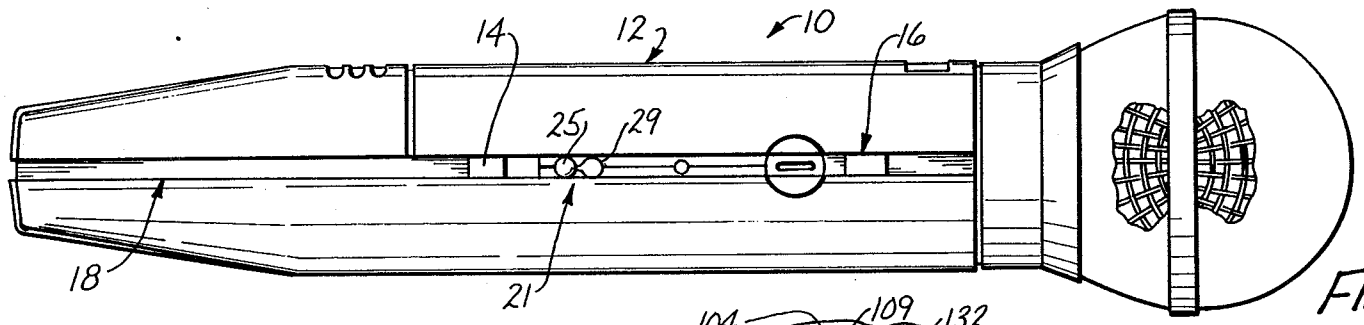
FIG. 1 is an enlarged side elevational view of a wireless microphone, which is constructed according to the present invention, and which includes a mute control button and an on/off control button disposed substantially entirely in a slit-like slot on the side of the microphone.
Figure 2:
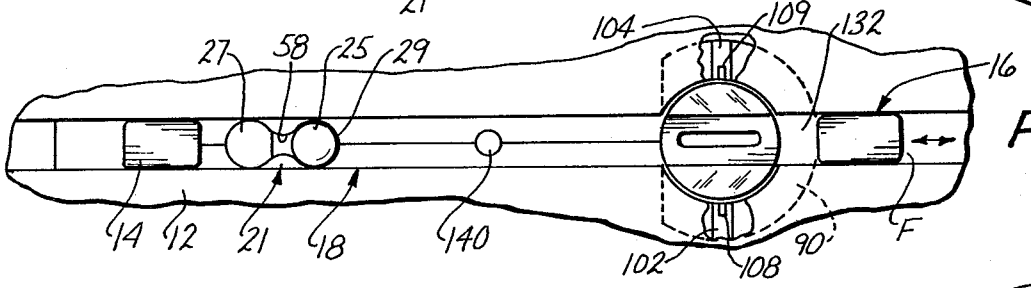
FIG. 2 is a greatly enlarged view of a portion of the microphone of FIG. 1, showing the mute control button in the locked position, and the on/off control button in the ON position.
Figure 3:
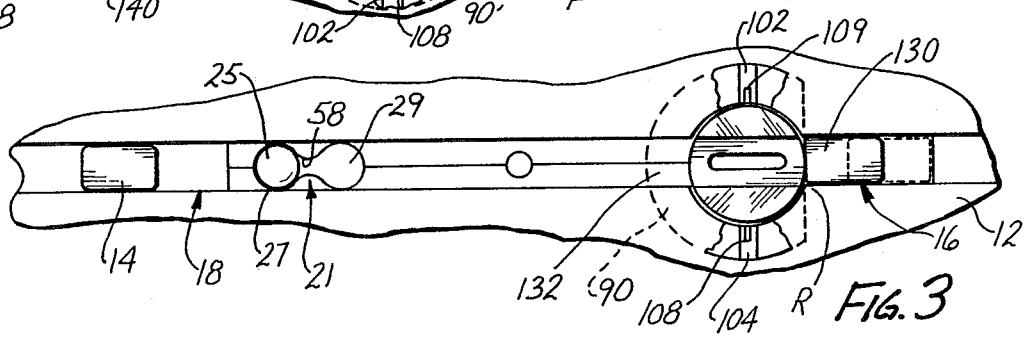
FIG. 3 is a greatly enlarged view of a portion of the microphone of FIG. 2, showing the mute control button and the on/off control button in reverse positions.
Figure 1A:
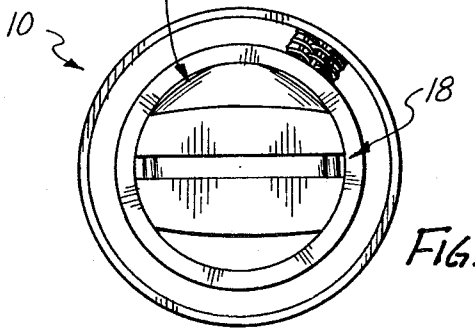
FIG. 1A is a somewhat enlarged rear face view of the microphone of FIG. 1.
Figure 1B:
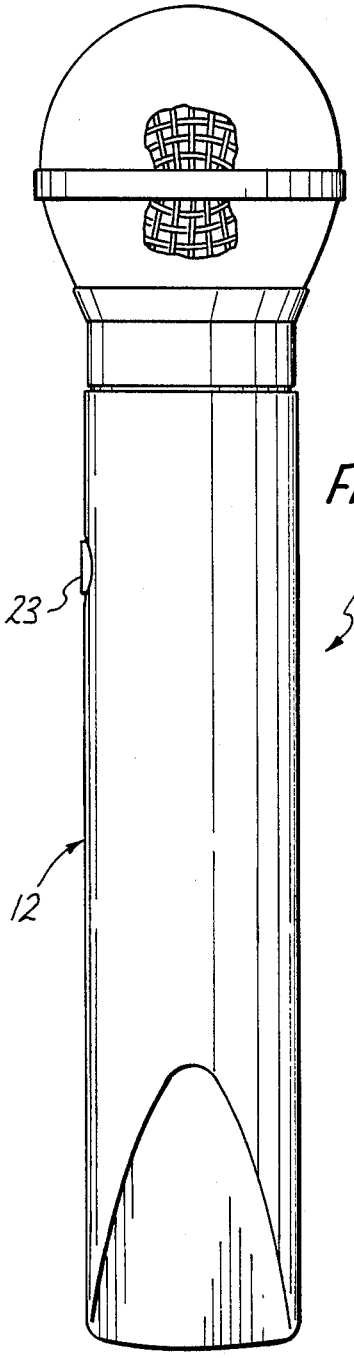
FIG. 1B is a somewhat enlarged bottom plan view of the wireless microphone of FIG. 1.
Figure 1C:
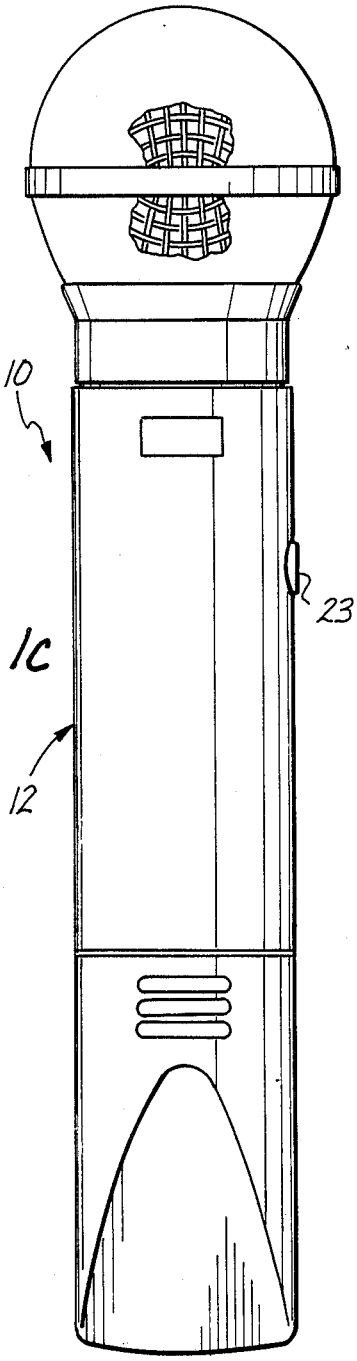
FIG. 1C is another somewhat enlarged top plan view of the wireless microphone of FIG. 1.

Referring now to the drawings, and more particularly to FIGS. 1–3 thereof, there is illustrated a wireless microphone 10, which is constructed in accordance with the present invention.

The wireless microphone 10 generally comprises an elongated hollow tubular handle 12, which includes a slit-like elongated axially-extending slot or recess 18.

The slot 18 is disposed on the side of the microphone 10, and it extends longitudinally substantially throughout the entire axial length of the handle 12.

As best illustrated in FIGS. 1, 1A, 1B and 1C, an on/off control button 14, and a mute control button 16 are disposed substantially entirely inside the elongated slot 18, and can be concealed from view by the fingers of the user when encircled thereabout. For the purpose of preventing inadvertent deactivation of the microphone, the on/off control button includes a detent member 21, which retains releasably the on/off control 14 in one of two selected discrete positions; and the mute control button 16 is provided with a mute control locking member 23, which locks the mute control button 16 in a deactivated position, or permits selectively its free activation or deactivation during use.

In operation, in order to transmit over the wireless microphone 10, for example, the user has to make sure that the on/off control button 14 is in the ON or activated position, and the mute control button 16 is in the locked or deactivated position.

In order to activate the on/off control switch 15, the user first presses downwardly a detent stud 25 of the detent member 21 with the tip of one of his or her thumb, and simultaneously forwardly slides the on/off control button 14 with the digits of the other hand, from the position as illustrated in FIG. 1, into the position as illustrated in FIG. 2. The stud 25, therefore, retracts out of a first OFF locking detent opening 27A, and snaps into a second ON locking detent opening 29, for locking the on/off switch button securely in the ON position. The on/off control button 14 cannot be inadvertently pushed into an OFF position by the fingers of the user, since it is recessed inside the slot 18, out of contact with the fingers of the user. Furthermore, in order to release the on/off control button 14 from its ON position, onto its OFF position, the user must voluntarily use both of his or her thumbs or other digits, to press down the stud 25 out of the second locking detent opening 29, and simultaneously to slide rearwardly, while pushing inwardly the on/off switch button 14. Therefore, such a two-handed manual manipulation can not be accomplished inadvertantly by one hand of the performer.

In order to lock the mute control button 16 in a deactivated position, a mute control locking member 23 is rotated about a radially extending axis, into blocking relationship relative to the path of travel of the mute control button 16 to prevent it from being accidentally activated by the fingers of the user during use. When it is desired to activate the mute switch 82, the mute control blocking member 23 is rotated 180° about its radial axis, to unblock the path of travel of the mute control button 16, for permitting the mute switch 82 (FIG. 4) to be closed for muting the microphone 10. The mute control locking member 23 is equipped with a detent 100, for retaining it releasably against rotation in one of two selected discrete positions, in order to prevent inadvertent movement of the mute button during the use of the microphone 10.

Considering now the on/off control button 14 and its corresponding detent member 21, in greater detail, with respect to FIGS. 4–8, it generally has a unitary construction, and is composed of a suitable resilient material, such as an electronic plastic material. The on/off control button 14 generally includes a flat base plate 35, and a raised finger engageable button portion 37, connected to the front surface 39 thereof. The on/off control button 14 further includes a rectangular open frame base member 40 which is integrally connected to an upstanding cantilevered button support member 35, bearing the button portion 37. The end 41 of the frame member 40, also has an L-shaped upstanding cantilevered finger member 42, having the detent stud 25 connected to the fixed end of the cantilevered finger 42. Thus, both cantilevered member 35 and 42 are adapted to be flexed inwardly toward the frame member 40.

Figure 5:
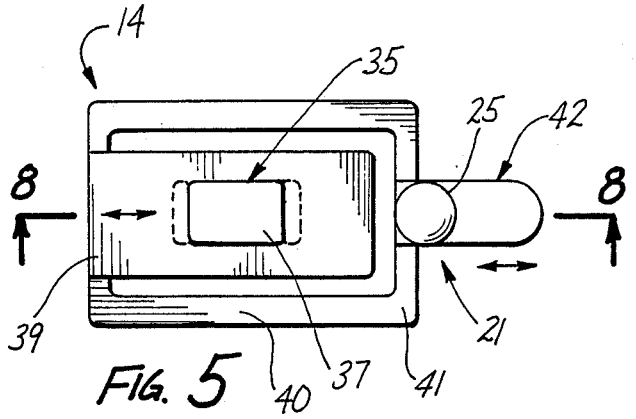
FIG. 5 is a greatly enlarged face view of the on/off control button of FIG. 2.
Figure 6:
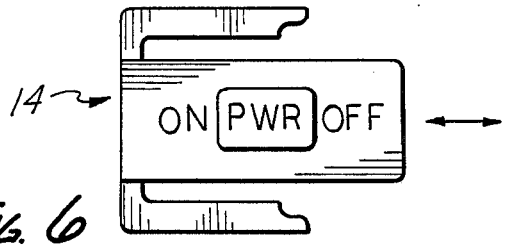
FIG. 6 is a greatly enlarged fragmentary face view of the on/off control button of FIG. 5.
Figure 8:
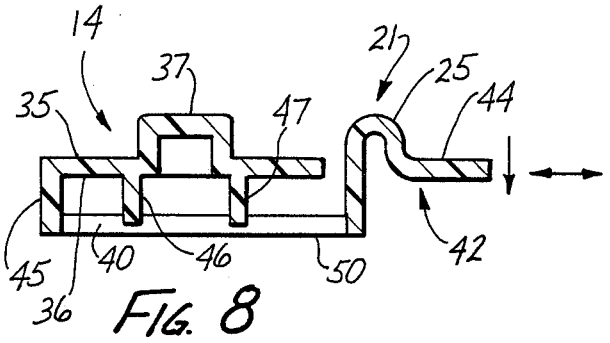
FIG. 8 is a greatly enlarged cross-sectional elevational view of the on/off control button of FIG. 5, taken on line 8—8 of FIG. 5.
Figure 7:
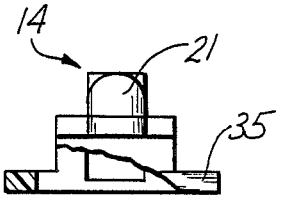
FIG. 7 is a greatly enlarged fragmentary front elevational view of the on/off control button of FIG. 5.
Figure 9:
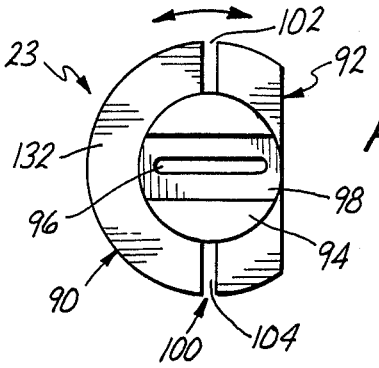
FIG. 9 is a greatly enlarged top plan view of the mute control locking member for the mute control button of FIG. 2.
Figure 10:
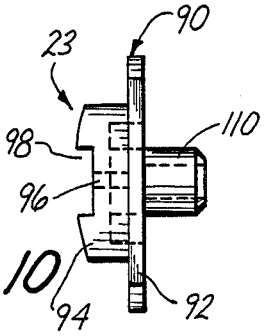
FIG. 10 is a greatly enlarged side elevational view of the mute control locking member of FIG. 9.
Figure 12:
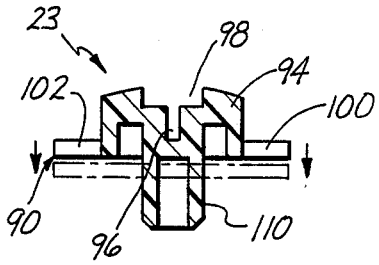
FIG. 12 is a greatly enlarged sectional side elevational view of the mute control locking member of FIG. 9, taken substantially on line 12—12 of FIG. 11.
Figure 11:
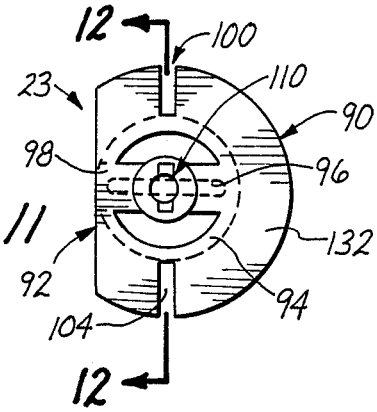
FIG. 11 is a greatly enlarged bottom plan view of the mute control locking member of FIG. 9.
Figure 13:
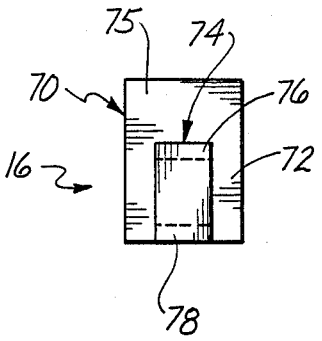
FIG. 13 is a greatly enlarged top plan view of the mute control button of FIG. 2.
Figure 14:
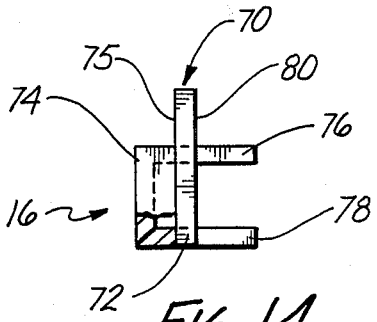
FIG. 14 is a greatly enlarged side elevational view of the mute control button of FIG. 13, with a portion thereof cut away for illustration purposes.
Figure 15:
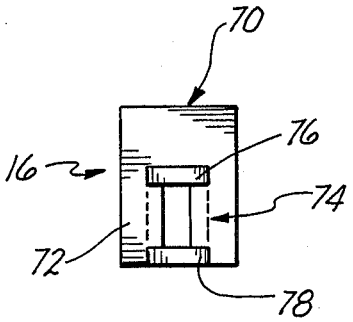
FIG. 15 is a greatly enlarged bottom plan view of the mute control of FIG. 13.

As indicated in FIGS. 5 and 8, the member 35, the member 40 and the button 37 are generally rectangularly shaped, with the button 37 generally disposed in about the mid portion of the member 35. The member 35 and the member 40 are shown planarly disposed in two generally parallel planes, and maintained spaced-apart by means of an upright post 45. The upright post 45 fixedly interconnects the base plate 35 and the cantilevered member 40.

Figure 4:
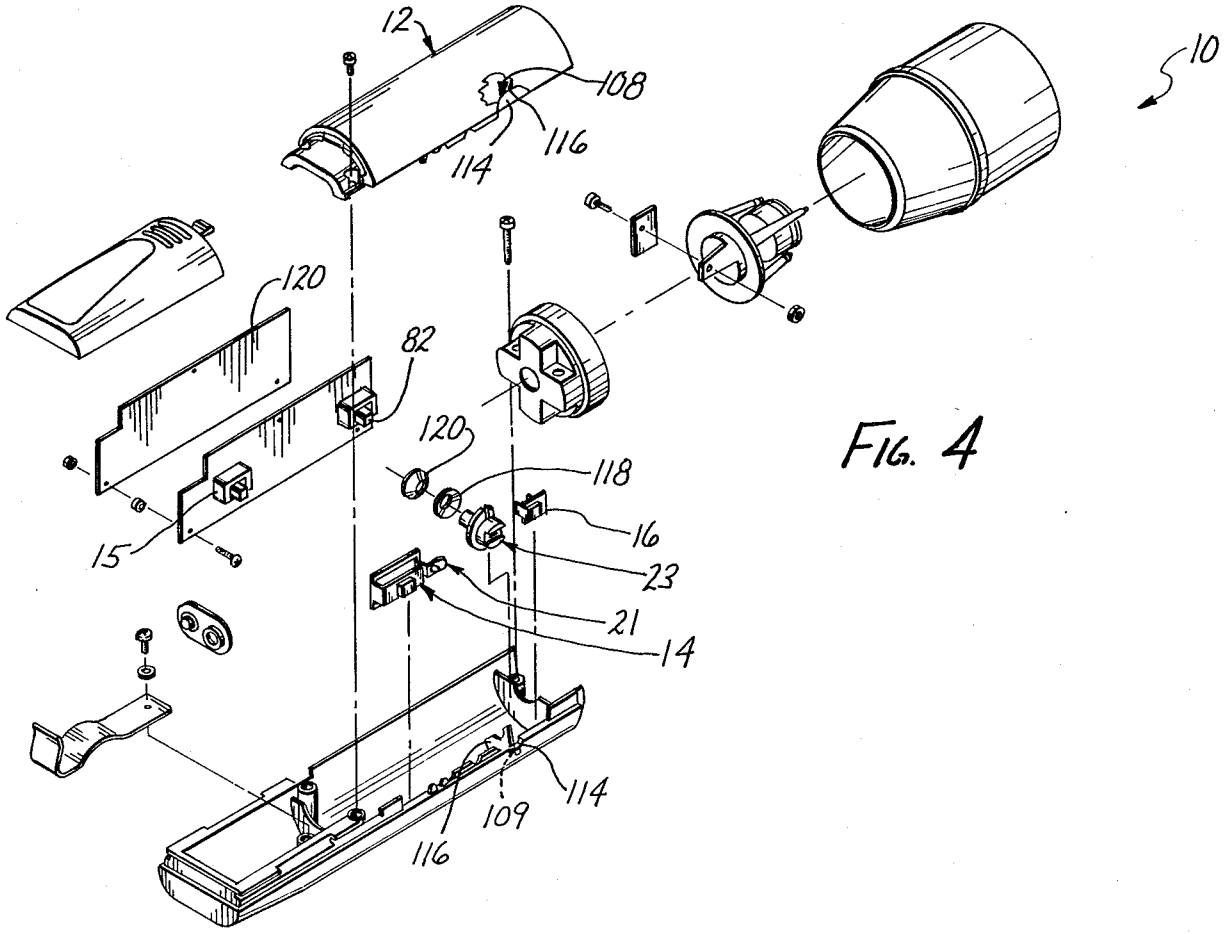
FIG. 4 is an exploded pictorial view of the wireless microphone of FIG. 1.

Two posts 46 and 47 generally integrally downwardly depend from the underside 36 of the member 35, so as to be positioned properly relative to and retain the on/off control switch 82 (FIG. 4). As is further illustrated in FIG. 8, the member 42 includes a generally horizontal leg 44, which is substantially coplanarly relative to the member 35, and which rests on the inside surface of the handle 12, when the member 40 is in an unstressed position.

As illustrated in FIGS. 2 and 3, the detent member 21 includes a pair of detent locking openings 27 and 29, disposed at the handle housing portion at the bottom of the elongate slit 18. The openings 27 and 29 are generally circularly shaped, and so dimensioned as to lockingly and releasably securely receive and retain the detent stud 25 therein. The two detent openings 27 and 29 are interconnected by an intermediate narrow passage 58, which is narrower than the cross-section of the detent stud 25, for securely retaining the stud 25 therein, and for preventing the inadvertent deactivation of the microphone 10 during use.

Considering now the mute control button 16 and the mute control locking member 23 in greater detail with respect to FIGS. 4 and 9–15, the mute control button 16 is best illustrated in FIGS. 4 and 13–15, and generally comprises a one-piece integral member 70, having a flat base member 72, and a raised bottom 74, which is connected to the front surface 75 of the base member 72.

The mute control button 16 further includes a pair of generally parallel legs 76 and 78, which integrally, generally perpendicularly project from the underside 80 of the base member 72. The two legs 76 and 78 are spaced-apart so as to fit over, and engage the mute switch 82, shown in FIG. 4. As best illustrated in FIG. 3, the mute control button 16 slides between a rearward activated position R (FIG. 3), and a forward deactivated position F (FIG. 2).

When the microphone 10 is in use, the mute control button 16 can be positioned in the locked position, for preventing any inadvertent activation of the mute button 16 and thus the mute switch 82. When mute control button 16 is in the unlocked position, the user can selectively activate or deactivate the mute switch 82, by sliding the mute control button 16 back or forth within the slot 18.

The unlocked position of the mute control 16 allows the performer to mute the microphone 10 temporarily, while performing on stage. In this regard, the performer can readily slide the mute control button 16 to the position R with the tip of a thumb, for muting the microphone 10. The user can also slide the mute control button 16 to the F position, in order to deactivate the muting feature, and to resume transmission over the microphone 10.

Considering now the mute control locking member 23 in greater detail, with respect to FIGS. 2–4 and 9–12, it generally has a unitary construction. The mute control locking member 23 generally includes a circular flange 90 having a cut out portion defining a flat 92 (FIGS. 9 and 11), which allows the mute control button 16 to slide into or out of the unlocked activated position R, as illustrated in FIG. 3. The mute control locking member 23 further includes a raised generally circularly shaped button 94, for enabling the user to rotate the mute control locking member 23 into one of two discrete positions. In this regard, the button 94 has a narrow screw driver slot or groove 96, and a larger thumb tip receiving groove 98, for rotating it into either of the discrete positions, as illustrated in FIGS. 2 and 3.

The mute control locking member 23 has the detent 100, which is disposed partly on the flange 90, and partly on the handle 12. The detent 100 includes a pair of detent openings 102 and 104, which are diametrically oppositely radially disposed on the flange 90, between the outer perimeter of the flange 90 and the perimeter of the button 94.

The detent 100 further includes a pair of detent locking ribs 108 and 109, which are integral with, and which protrude from, the handle 12, to engage lockingly the detent openings 102 and 104. The locking detent ribs 108 and 109 lockingly fit inside the detent openings 102 and 104, so as to lock releaseably the mute control locking member 23 against rotation about its radial axis. The button 94 rotatively fits inside a circular opening 114, in the handle 12, and the flange 90 loosely fits inside a longitudinal slit-like groove 16 in the handle 12.

The mute control locking member 23 further includes a substantially cylindrical post 110, which integrally depends from the flange 90, and which generally protrudes perpendicularly inwardly therefrom. The post 110 urges against a pair of leaf springs 118 and 120, for compressing them against a flat plate 120. The leaf springs 118 and 120 urge the post 110 resiliently radially outwardly, in order to cause the integral ribs 108 and 109 to engage, and to be retained inside, the detent openings 102 and 104.

In order to rotate the mute control locking member 23, the user has to push it inwardly against the force of the leaf springs 118 and 120; thus, forcing the detent openings 102 and 104 below the detent ribs 108 and 109. The user then rotates the detent openings 102 and 104 out of engagement with the detent ribs 108 and 109.

When the mute control locking member 23 is in the unlocked position, and the mute control button 16 is in the forward position, a clearance space 130 (FIG. 3) separates the mute control button 16 and the mute control locking member 23. The clearance space 130 enables the user to detect the generally silver colored flat plate 120, as a visual indication and warning, that the mute control locking member 23 is in the unlocked position. When the mute control locking member 23 is in the locked position illustrated in FIG. 2, the arcuate portion 132 of the flange 90, acts in blocking relationship relative to the path of travel of the mute control 16 inside the slit-like slot 18.

Generally, when the performer decides to leave the stage, he or she hands the microphone 10 over to a technician. The technician then deactivates the on/off switch 115, by depressing the detent stud 25, and by simultaneously sliding the on/off control button 14 in the OFF position. The technician could also deactivate the mute switch 82, by depressing the mute control locking member 23, by rotating it about its axis through 180°, and by sliding the mute control 16 rearwardly into the R position (FIG. 3), against the flat portion 92. As soon as the performer is ready to return on the stage, the technician restores the on/off control button 14 to the ON position, and the mute control locking member 23 to the locking position, as shown in FIG. 2. Alternatively, if desired, the mute button can be left unlocked for use by the performer.

The on/off control button 14, and the mute control locking member 23, are differently configured and operate differently, in order to minimize the possibility of the user operating the wrong safety control device.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A wireless microphone having an on/off switch and a mute switch, comprising:

a generally elongated tubular handle means having a slit-like elongated slot being disposed on the side of the microphone, and extending throughout substantially the entire axial length of said handle means;

a first control means, for selectively activating the on/off switch;

a second control means, for selectively activating the mute switch;

said first control means being of unitary construction and resilient composition comprising an integral flat base plate member for slidingly manipulating said first control means inside said slot and a spaced apart detent means, said detent means being depressible downwardly by the finger tips on one hand of a user and said flat base plate being slidable by the finger tips of the opposite hand only of the user as said detent means is depressed downwardly for selectively retaining positioning the on/off switch in a desired discrete position; and said first and second control means being disposed substantially entirely within said elongated slot, out of contact with the user's fingers, to prevent inadvertent manipulation thereof.

2. A microphone according to claim 1, wherein said detent means includes an integral cantilevered member of resilient composition, said cantilevered member depending downwardly from one end of said base plate member, for supporting an integral detent stud.

3. A microphone according to claim 2, wherein said elongated slot includes a pair of detent openings being generally shaped and dimensioned to receive, and to retain said stud member in predetermined discrete positions.

4. A microphone according to claim 3, wherein said detent openings are interconnected by an intermediate passage, said passage being narrower than the cross-section of said detent stud, for preventing the movement of said detent stud from one detent opening to the other detent opening through said passage to prevent the inadvertent deactivation of the microphone during use.

5. A microphone according to claim 2, wherein said cantilevered member is generally L-shaped.

6. A microphone according to claim 1, further including a pair of generally parallel legs projecting downwardly from the underside of said base plate member for engaging the on/off switch.

7. A microphone according to claim 1, wherein said second control means includes a mute control button, for selectively activating the mute switch.

8. A microphone according to claim 7, further including a mute control locking means, for maintaining said mute control button in a discrete locked position.

9. A microphone according to claim 7, wherein said mute control button includes a flat base member and a pair of generally parallel legs downwardly projecting from the underside of said base member, for engaging the mute switch.

10. A microphone according to claim 8, wherein said mute control locking means comprises a generally circular flange, having a cut out portion for defining a flat portion, for allowing said mute control button to slide into an unlocked position.

11. A microphone according to claim 10, further comprising a raised generally circularly shaped button for rotating said mute control locking means into a discrete position.

12. A microphone according to claim 10, wherein said circular flange includes a detent having a pair of openings, being generally diametrically radially disposed on said flange and being generally shaped and dimensioned to receive, and to retain a corresponding pair of ribs of integral construction within said handle means, for lockingly engaging said pair of openings.

13. A microphone according to claim 10, further including a post, said post integrally generally perpendicularly protruding from said flange; and a pair of leaf springs for urging said post resiliently radially outwardly, for keeping said ribs in locking engagement with said detent openings.

14. A method of using the first control means of claim 3, comprising:

depressing said detent stud with the tip of one thumb; and sliding said base plate member of said first control means, for causing said stud to ride out of one of said detent opening, and to snap into the other detent opening.

15. A method of using the second control means of claim 12, comprising:

pressing said flat base member with the tip of one thumb, for forcing said detent openings below, and out of engagement with said detent ribs;

rotating said mute control locking means about 180°;

releasing said flat base member for engaging said detent ribs inside said detent openings; and sliding said mute control button into a desired discrete position.

* * * * *